US005887969A

United States Patent [19]

Gordin

[11] Patent Number: 5,887,969

[45] Date of Patent: Mar. 30, 1999

[54] PRECISE ECONOMICAL REFLECTOR

[75] Inventor: Myron K. Gordin, Oskaloosa, Iowa

[73] Assignee: Musco Corporation, Oskaloosa, Iowa

[21] Appl. No.: 804,741

[22] Filed: Feb. 21, 1997

[51] Int. Cl.[6] ..... F21V 17/02

[52] U.S. Cl. ..... 362/347; 362/217; 362/296; 362/433

[58] Field of Search ..... 362/217, 220, 362/223, 224, 296, 297, 306, 344, 347, 433, 438, 439

[56] References Cited

U.S. PATENT DOCUMENTS

| | | | |
|---|---|---|---|
| 1,991,584 | 2/1935 | Strauss | 362/153.1 |
| 3,099,403 | 7/1963 | Strawick | 362/224 |
| 3,609,337 | 9/1971 | Adra et al. | 362/306 |
| 3,634,675 | 1/1972 | Madsen et al. | 362/303 |
| 3,686,495 | 8/1972 | Medley | 362/223 |
| 4,087,682 | 5/1978 | Kolodziej | 362/297 |
| 4,229,785 | 10/1980 | Tuller | 362/433 |
| 4,412,276 | 10/1983 | Blinow | 362/223 |
| 4,868,727 | 9/1989 | Ponds et al. | 362/344 |
| 5,117,343 | 5/1992 | Kerscher et al. | 362/297 |
| 5,337,221 | 8/1994 | Gordin et al. | 362/233 |
| 5,343,374 | 8/1994 | Gordin et al. | 362/153.1 |
| 5,363,293 | 11/1994 | Lasker | 362/302 |
| 5,402,327 | 3/1995 | Gordin et al. | 362/298 |
| 5,519,590 | 5/1996 | Crookham et al. | 362/139 |
| 5,595,440 | 1/1997 | Gordin et al. | 362/247 |
| 5,647,661 | 7/1997 | Gordin | 362/283 |

FOREIGN PATENT DOCUMENTS

| | | | |
|---|---|---|---|
| 373814 | 12/1963 | Switzerland . | |
| 415840 | 1/1967 | Switzerland . | |
| 877341 | 9/1961 | United Kingdom | 362/220 |

*Primary Examiner*—Alan Cariaso
*Attorney, Agent, or Firm*—Zarley, McKee, Thomte, Voorhees & Seas

[57] ABSTRACT

A reflector used in a lighting fixture wherein a relatively thin, flexible, reflecting surface is placed against a precisely formed curve in a frame. The reflecting surface is then clamped against the precisely formed curve and adopts the shape of precisely formed curve. A method according to the invention cuts the precisely formed curve from a piece and then uses both parts of the piece to clamp the reflective surface in place. It is preferred that the reflective sheet be placed against and clamped at least at opposite edges.

30 Claims, 9 Drawing Sheets

PRECISE ECONOMICAL REFLECTOR

INCORPORATION BY REFERENCE

The specification and drawings of U.S. application Ser. No. 08/375,650, filed Jan. 20, 1995 for inventor Myron K. Gordin is incorporated by reference herein.

BACKGROUND OF THE INVENTION

A. Field of the Invention

The present invention relates to lighting reflectors, fixtures, and systems, particularly high-intensity lighting reflectors, fixtures and systems to illuminate large areas or volumes of space.

B. Problems in the Art

Powerful light sources have been around for some decades. By powerful light sources, it is meant, light sources that provide a high amount of light intensity from a relatively small physical structure.

An example of such a high-intensity light source is a metal halide arc tube. There has been a continued evolution in the development of reflectors and lighting fixtures that can be advantageously used with such high-intensity light sources. There exists, however, a continued need to better utilize such light sources and to better control such high-intensity light power efficiently and economically.

One of the difficulties with high-intensity light sources is how to control the light so that it is useful. There are situations where very precise control and cut-off of light is advantageous. This requires, however, high precision in the manufacture and arrangement of the components which most times results in high cost for the lighting fixture.

There have been attempts to address these problems. U.S. Pat. No. 5,402,327 issued Mar. 28, 1995 to inventors Gordin and Crookham, discloses a system whereby significant amount of control and cut-off of light is accomplished. A light source with a primary reflector is positioned so that the light emanating from that light source and primary reflector is actually directed away from the target area. What is called a secondary reflector is positioned away from the light source and primary reflector. It is shaped or has segments which are adjustable so that light from the light source and primary reflector is controlled in a manner that can produce almost absolute cut-off, at least along one perimeter boundary of the composite beam that is directed to the target area from the secondary reflector. One disadvantage of the system disclosed in this patent is that the components are separated and generally the secondary reflector is of fairly substantial size. It is therefore somewhat cumbersome to manufacture, ship, install, and maintain. The size of the components also make it relatively costly.

Inventor Gordin then addressed some of these problems in a fixture disclosed at U.S. application Ser. No. 08/375,650, filed Jan. 20, 1995, now U.S. Pat. No. 5,647,661. The advantage of the structure disclosed in that application is that it can be contained within a relatively small housing, which can also be protected from the elements. One of the embodiments disclosed utilizes a plurality of mirror segments which are highly specular and which can be individually adjusted to control the beam emanating from the fixture.

However, mirror segments are relatively costly. Also, making the precise mirrors, mounting and aiming them for each application and maintaining correct aiming in cooperation of the components is costly and labor intensive. While substantial control of light can be accomplished, the above costs in terms of money and labor time defines an area for improvement in the art. The systems defined above are generally only within the financial reach of those able to afford costly lighting systems. There is therefore a need in the art for a reflector or lighting fixture that allows the advantages of high control of light, at least in certain portions of the light beam, but which can be accomplished in a more economical manner, with less labor involvement.

While it is possible to get a relatively precise beam and control that beam through certain manufacturing processes, the tooling and finishing of such products is extremely costly.

Additionally, high control of light requires highly specular reflecting surfaces. As discussed above, while mirrors and mirror-like surfaces are highly specular, they are costly.

Processes such as stamping or short-run tooling for materials such as aluminum are known in the art. However, these processes cannot produce precise enough curves or shapes to have high control of lighting. Additionally, there is some difficulty in obtaining highly specular reflecting surfaces with these types of manufacturing processes.

Therefore, there is no known way in the art to provide a very precise, highly specular reflector in an economical manner.

It is therefore the primary object of the present invention to provide a precise, economical reflector and light fixture, and method of making the same, and method for producing precise lighting with an economical reflector which proves over or solves the problems or deficiencies in the art.

Other exemplary objects, features, advantages of the present invention are:

1. Use of an economical material to produce a highly controllable beam.
2. Creation of highly precise reflector shape.
3. Provision of the material and preciseness at a reasonable cost.
4. Substantial reduction in labor time and resources in manufacturing and installing and maintaining of lighting fixtures.
5. Elimination of the need for specialized tooling to create the reflector.
6. Highly repeatable manufacturing.
7. Flexibility with regard to creating different light beams and effects on a custom yet precise basis.
8. Economy whether a number of fixtures are manufactured or only one is manufactured.

These and other objects, features, and advantages of the present invention will become more apparent with reference to the accompanying specification and claims.

SUMMARY OF THE INVENTION

The present invention includes a reflector for providing a precise curvature for a reflecting surface. A frame includes a contour in the form of a curve. The contour is precisely made. A reflecting surface is positioned to follow the contour and, therefore, assumes the precise shape of the contour. A clamping or securing mechanism secures the reflecting surface to the contour.

This apparatus allows for the economical use of a flexible, reflective sheet material, which is economical and can be used for contours of various shapes to produce various desired beam configurations.

A precise reflecting surface, made at a reasonable cost according to the invention, can be made according to the following process. A precise curve is cut in a plate so that first and second pieces of the plate on opposite sides of the cut are formed. A thin, flexible, reflecting surface is placed between the first and second pieces of the plate. The first and second pieces of the plate are then brought together to clamp the flexible, reflecting sheet in place and to conform it to the precise curve.

A method according to the invention includes placing a flexible reflecting surface against a precisely formed curve and clamping the surface in place against the curve.

DETAILED DESCRIPTION OF THE PREFERRED EMBODIMENT

A. Overview

Figure 1:
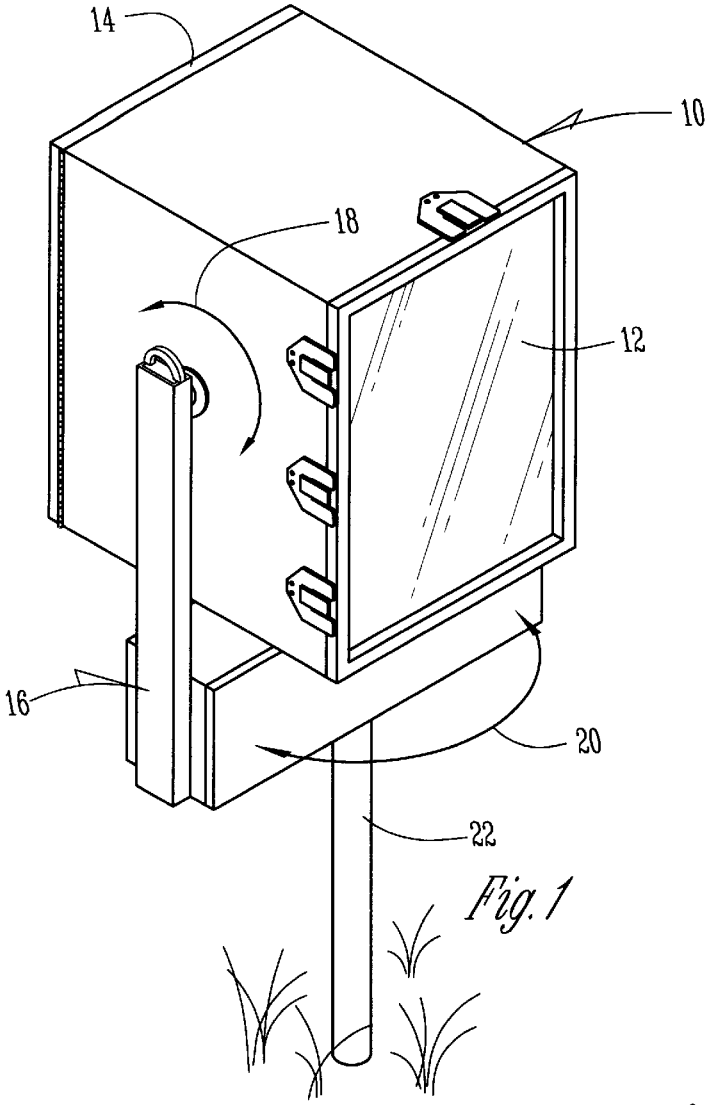
FIG. 1 is a prospective view of a housing which can contain a reflector according to a preferred embodiment of the present invention.

To assist in an understanding of the invention, a preferred embodiment will now be described in detail. Frequent reference will be taken to the drawings. Reference characters will be used to indicate certain parts and locations in those drawings. The same reference characters will be used to indicate the same parts or locations throughout the drawings, unless otherwise indicated.

The structure of the preferred embodiment will first be set forth, followed by a description of a process for making the preferred embodiment. Thereafter, operation of the invention will be discussed, followed by a discussion of options, features, and advantages of the preferred embodiment.

B. Incorporation by reference

U.S. patent application Ser. No. 08/375,650 now U.S. Pat. No. 5,647,661 incorporated by reference herein, sets fourth details regarding the structure and operation of a housing that is used with the preferred embodiment. It also sets forth a discussion of examples of how light beams with precise control can be utilized advantageously. Reference can be taken to that patent application and the disclosure set forth there will not be repeated here for brevity.

C. Structure

FIG. 1 shows a housing 10 having hingable front lens 12 and hinged back door 14. Housing 10 is placed on gimbal mount 16 to allow it to be pivoted around an horizontal axis (see arrow 18), and around a vertical axis(see arrow 20).

As will be discussed further below, the interior of housing 10 contains components which allow the generation and issuance of a light beam through front lens 12.

Figure 2B:
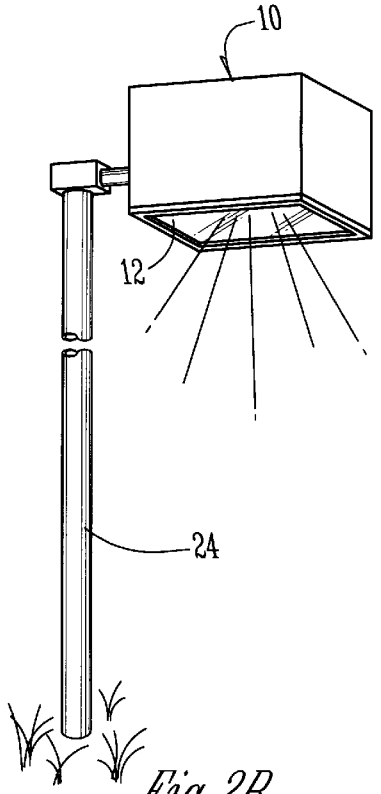
FIG. 2B is a prospective view of an alternative aiming orientation and method of elevation of a housing of FIG. 1.
Figure 2A:
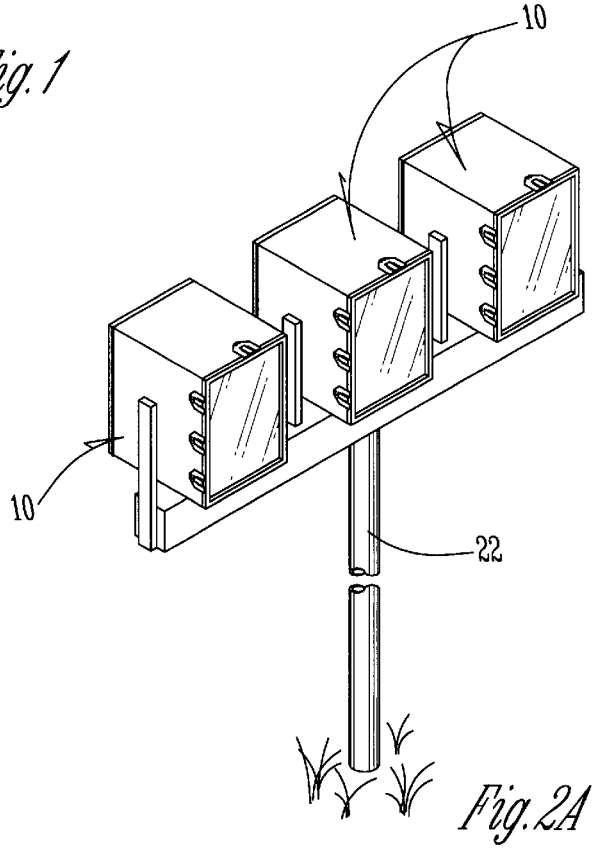
FIG. 2A is a prospective view of multiple housings of FIG. 1.

FIG. 2A illustrates that multiple fixtures contained in housings 10 can be placed on a single pole 22. Horizontal and vertical adjustment of each fixture can be built into such an arrangement. Alternatively, a plurality of fixtures in housings 10 can be placed at separate locations relative to the target area.

FIG. 2B, on the other hand, illustrates that a housing 10, incorporating in its interior a preferred embodiment of the invention, can be configured on a pole 24 in such a manner that a beam from housing 10 issues in a generally vertical manner, as compared with FIGS. 1 and 2A where the beam is issuing in a generally horizontal manner.

Figure 3:
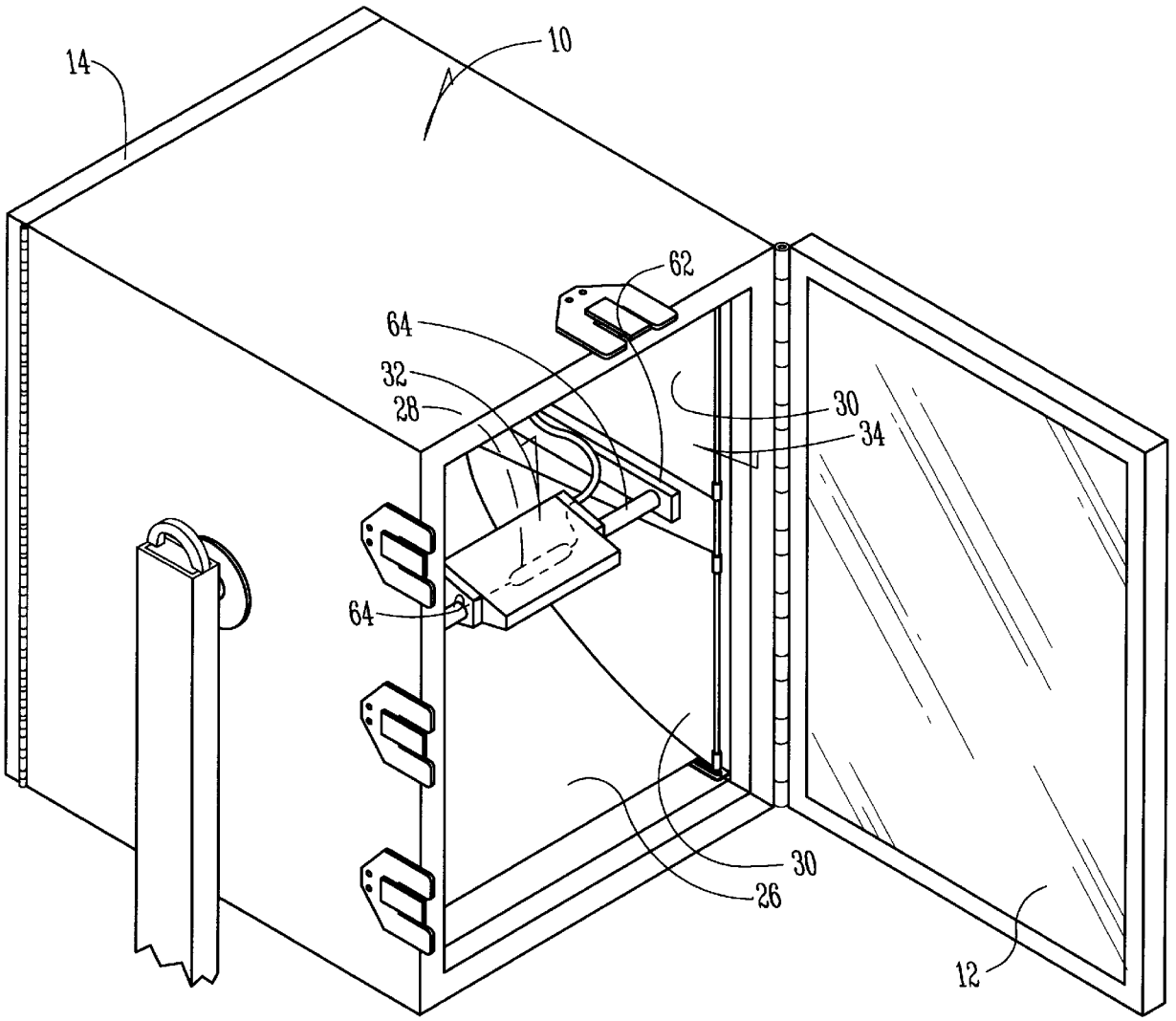
FIG. 3 is an enlarged prospective view of a housing of FIG. 1 showing a portion of a reflector and lighting fixture according to a preferred embodiment of the present invention.

FIG. 3 shows some of the interior of housing 10. The details regarding the hingable front lens 12, gimbal mount 16, and other aspects of housing 10 are set forth in U.S. Ser. No. 08/375,650.

A reflector 26, light source 28, and side reflectors 30 are shown inside housing 10 in FIG. 3. Reflector 26 is a single piece, flexible, thin sheet of aluminum. Light source 28 contained within light source mount 32 is held in front of reflector 26 by light mount 32. The details regarding light source 28 and light mount 28 can be found in U.S. Ser. No. 08/375,650.

Side mirrors 30 are mounted on rods 34 (only one shown in FIG. 3) and exist on opposite sides of reflector 26. The details regarding side reflectors 30 and their adjustable mount inside housing 10 can also be seen by referring to U.S. Ser. No. 08/375,650.

Figure 4:
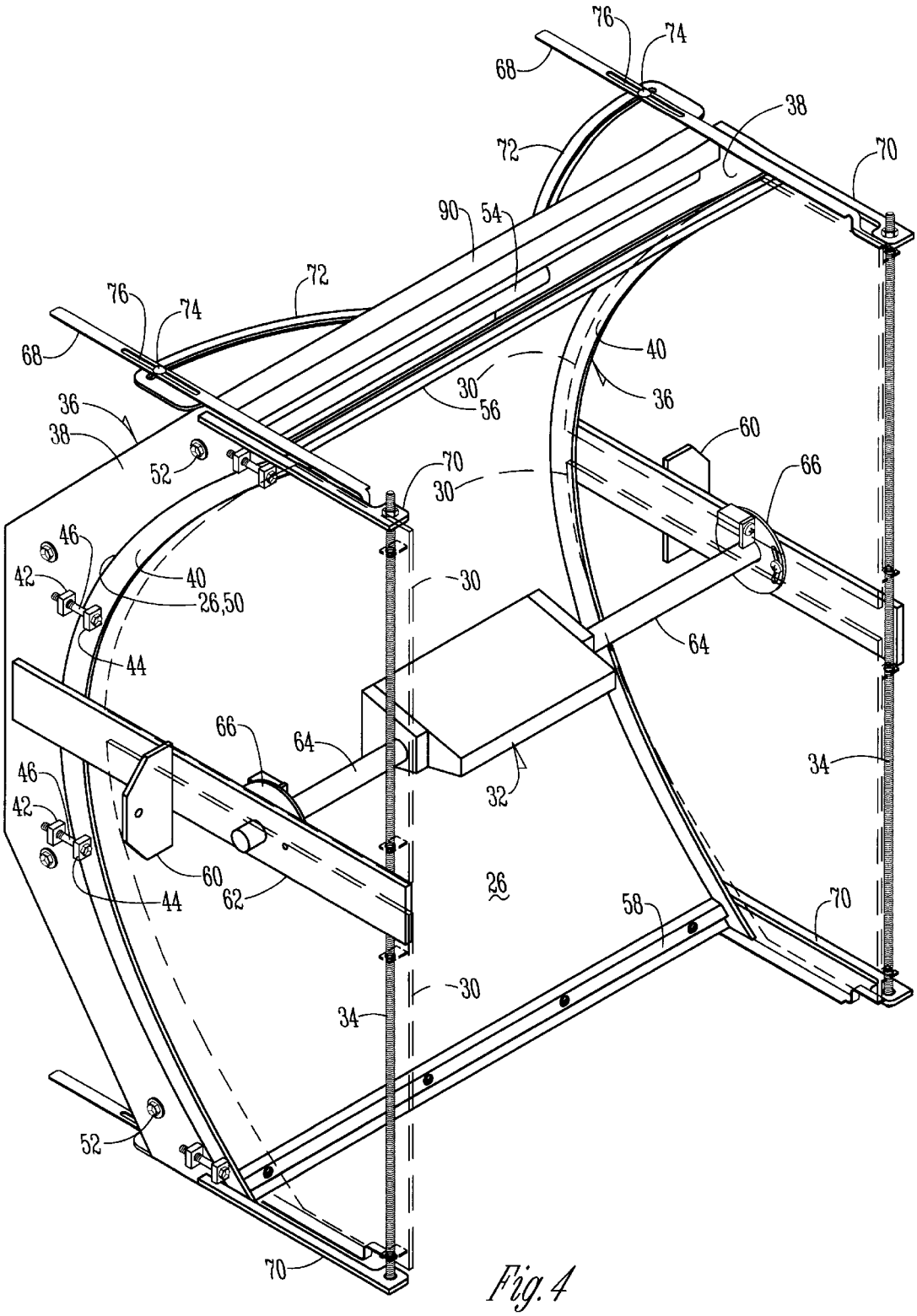
FIG. 4 is a still further enlarged prospective view of the lighting fixture and reflector of the interior of the housing of FIG. 3, without side reflectors for clarity.

FIG. 4 shows the structure of reflector 26 and its associated structures. Reflector 26 is mounted in what will be generally called frame 36. Frame 36 includes identical clamping mechanisms at opposite sides of reflector 26. Each clamping mechanisms comprises a base portion 38 and a mating portion 40. The side edges of reflector 26 are clamped between base portion 38 and mating portion 40. Reflector 26 therefore assumes the shape of the curve or contour formed between base and mating portions 38 and 40.

It can be seen that the clamping actions of portions 38 and 40 is accomplished as follows. Nuts 42 and 44 are welded to the outer sides of base portion and mating portion 38 and 40 respectively at spaced apart locations along curve 50 (defined by the junction of base and mating portion 38 and 40). Bolts 46 are threaded through nuts 42 and 44. By tightening bolts 46 into nuts 42 and 44, mating portion 40 is brought towards base portion 38. Reflector 26 is thus clamped between portions 38 and 40.

The same is true of both sides of reflector 26. At the point indicated by bolts 52 (behind reflector 26) cross-bars 54 (see FIG. 9 for example) interconnect opposite base portions 38. Additionally, upper and lower cross-members 56 and 58 extend between the upper and lower ends of mating portions 40 and across the upper and lower edges of reflector 26.

Thus, portions 38, 40, along with cross-bars 54 and upper and lower cross-members 56 and 58 comprise the basic frame for reflector 26. The general frame 36 is inserted in and bolted in position inside housing 10.

For example, ears 60 extending from bars 62 could be used to connect frame 36 to housing 10. Bars 62 are welded or otherwise attached to the outside of base portions 38 and extend forwardly. Cross-bar 64 holds up light mount 32 in front of reflector 26. As will be explained in more detail later, adjustment plate 66 at the junction of cross-bar 64 to bar 62 allows some rotation of light mount 32 relative to reflector 26.

FIG. 4 also shows side mirror mounts 34 which essentially consist of threaded rods extending between upper and lower arms 68 and 70 on opposite sides of reflector 26. Curved tracks 72 are positioned at the top aid bottom of frame 36. A pin 74 is contained within slot 76 in upper and lower arms 68 and 70. Pin 74 is attached track 72. The front end of upper and lower arms 68 and 70 is pivotally connected around side reflector mounts 34. Therefore, movement of upper arms 68, for example, inwardly along track 72 would pivot the upper side mirror inwardly. The same thing would be true for lower side mirrors 30 if attached lower arms 70.

Figure 5:
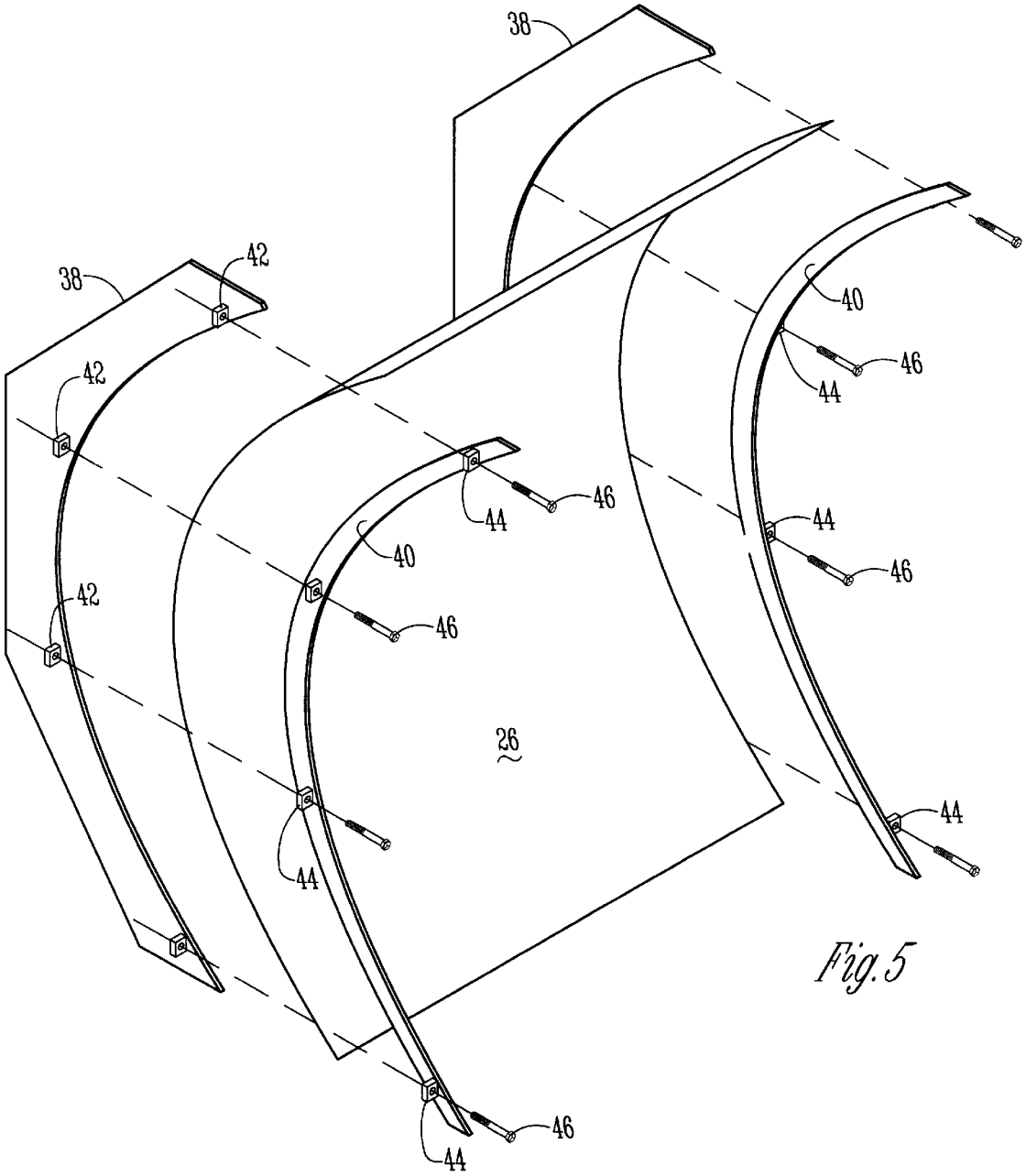
FIG. 5 is an isolated, prospective, exploded view of a reflective surface and the frame members associated with the reflective surface according to embodiment of FIG. 4.
Figure 6:
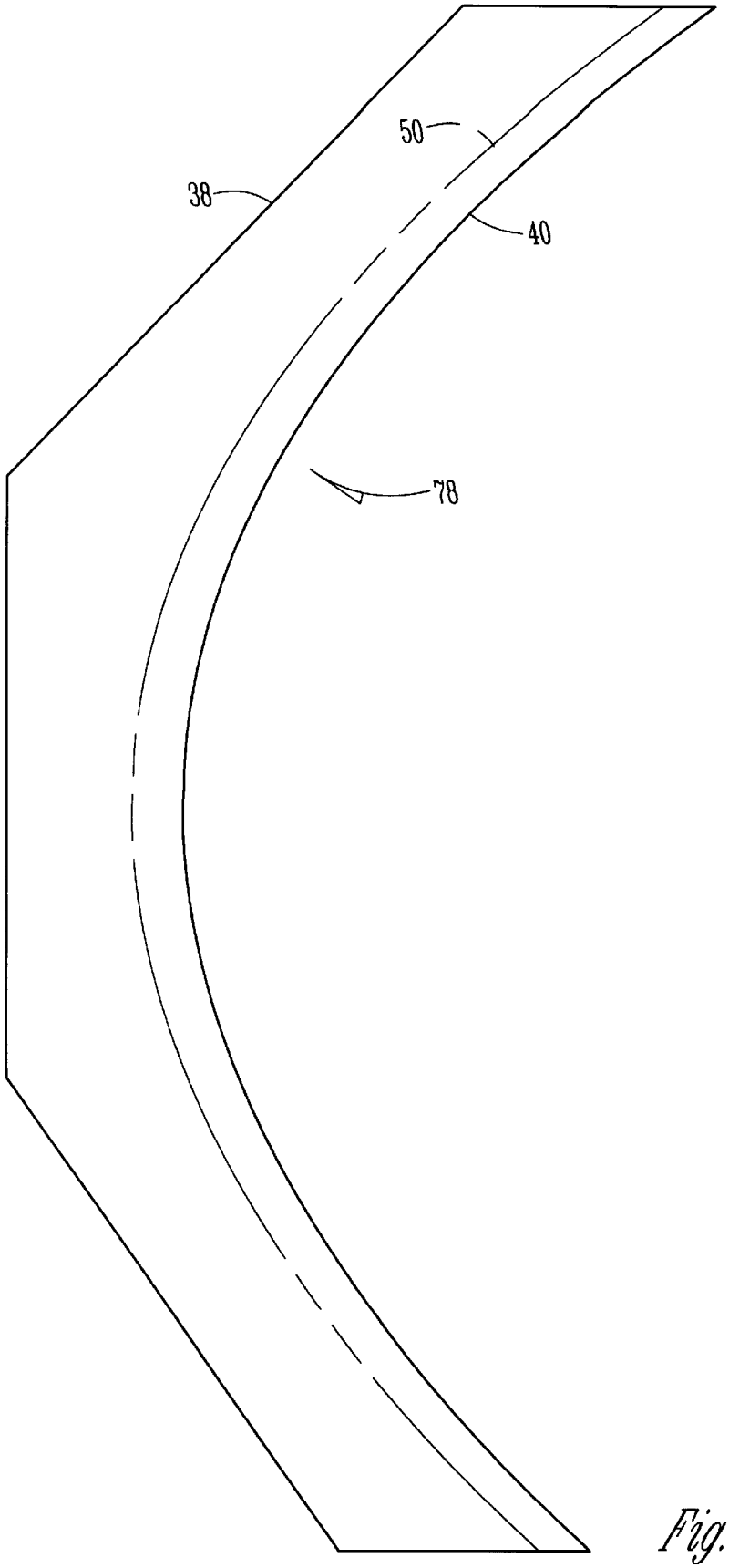
FIG. 6 is an enlarged, side, elevational view of a plate from which the frame members of FIG. 5 are created.

By referring to FIGS. 5–8, the method of making the structure of FIG. 4 which supports reflector 26 can be shown. FIG. 6 illustrates that base and mating portions 38 and 40 can be made by first shaping a single piece 78 to the general dimensions and perimeter profile as shown in FIG. 6. Piece 78 can then be cut into two pieces along line 50. Those two pieces would then become base portion 38 and mating portion 40.

In the preferred embodiment piece 78 is made of steel. Curve 50 is cut by laser cutting mechanisms, which can make extremely precise cuts, including though steel. It is further to be understood that curve 50 can be made to desire. The preciseness of cutting is allowed by fixing piece 78 into a known coordinate system in allowing the laser to very accurately follow a defined curve, for example. That curve can be defined using a computer assisted drawing (CAD) program to daraw the curve based on the lighting needs for that reflector. The CAD curve would be calibrated to the actual coordinate system related to piece 78. The cutting of curve 50 can be within approximately 0.002 inches.

For each lighting fixture, identical sets of base and mounting portions of 38 and 40 are made. In other words, two pieces 78 are cut so that curve 50 is identical for both pieces.

As shown in FIG. 5, therefore, the identical sets of base and mating portions 38 and 40 absolutely, matingly fit together because they come from piece 78. Flexible reflector 26, here a 0.020 inches thick, highly specular aluminum available from Alanod (Germany), could not accurately be supported for operation by simply securing its top and bottom edges. It therefore fits at its side edges into the receiving curve formed in base portion 38 and assumes that shape. Mating portion 40 then is inserted over reflector 26 and bolts 46 are threaded into nuts 42 and 44 to clamp reflector 26 in position.

Because the assembly of FIGS. 4–8 will be placed inside of housing 10, the elements or other forces will not impact on the middle portion of reflector 26, and, therefore, it will assume the accurate and precise curvature of curve 50.

Figure 7:
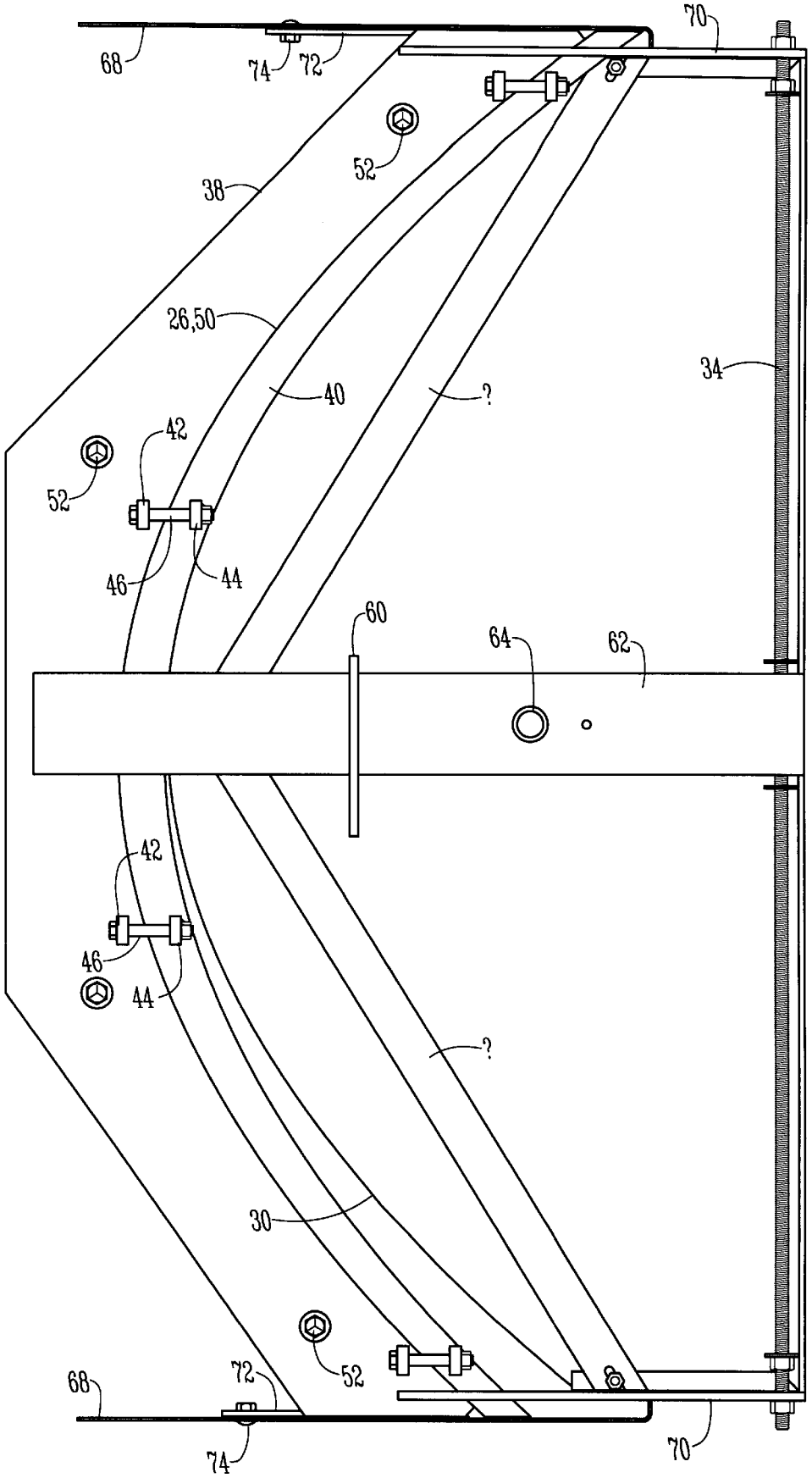
FIG. 7 is an enlarged, side, elevational view of FIG. 4.
Figure 8:
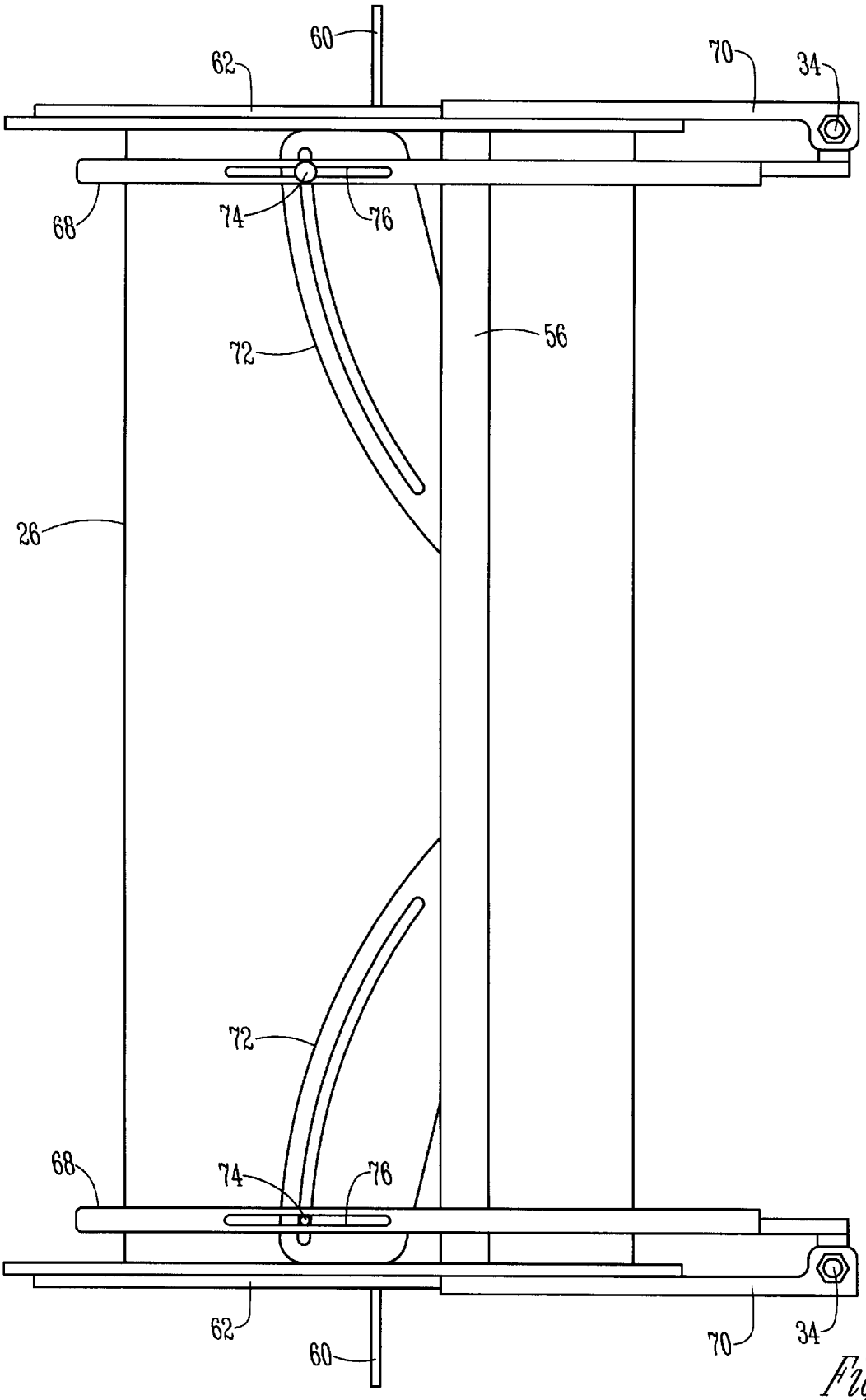
FIG. 8 is an enlarged, top, plan view of FIG. 4.

FIG. 7 shows reflector 26 clamped in position from side view, and FIG. 8 shows the clamped in position from top view.

Figure 9:
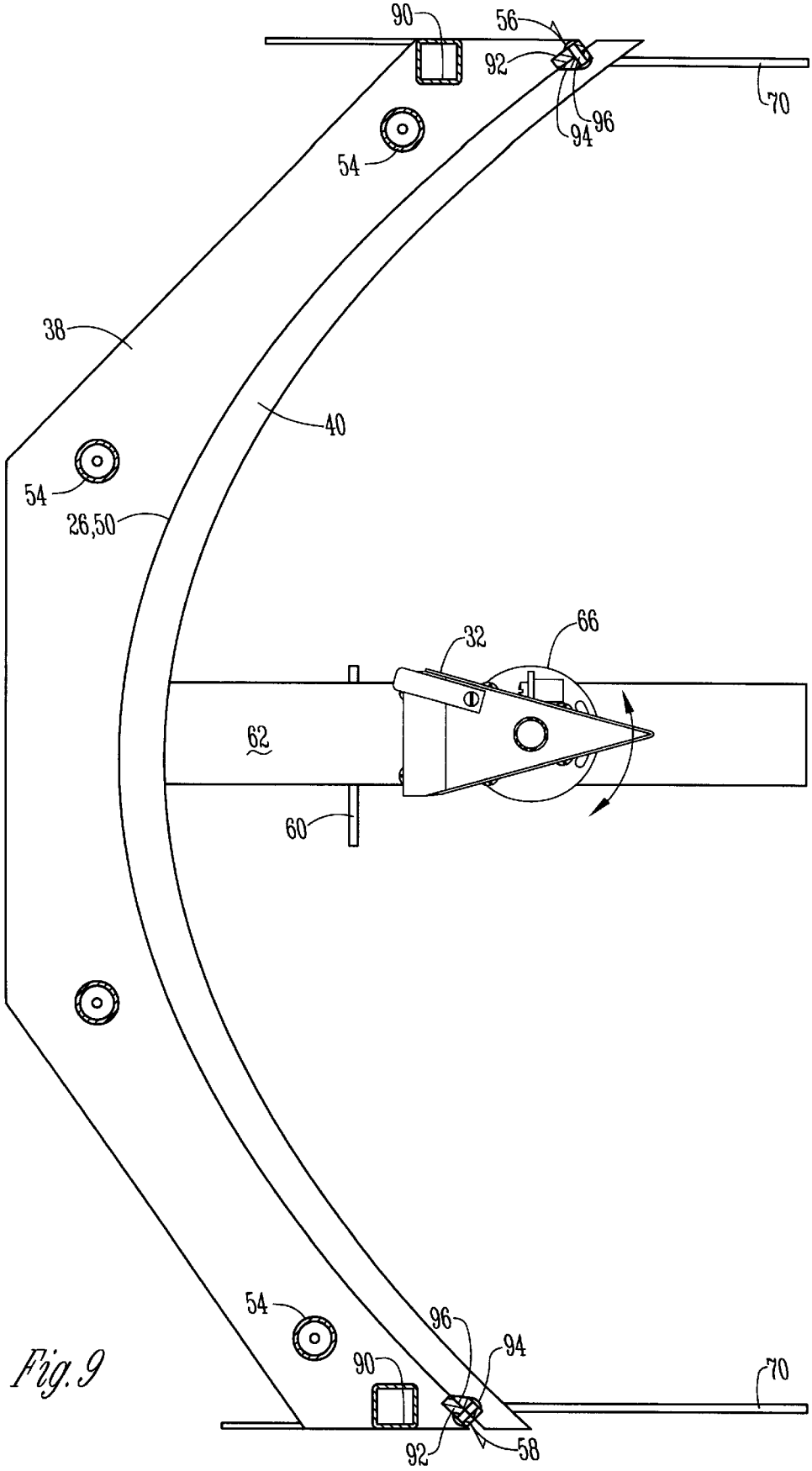
FIG. 9 is a sectional view taken along line 9—9 of FIG. 4.
Figures 10, 11:
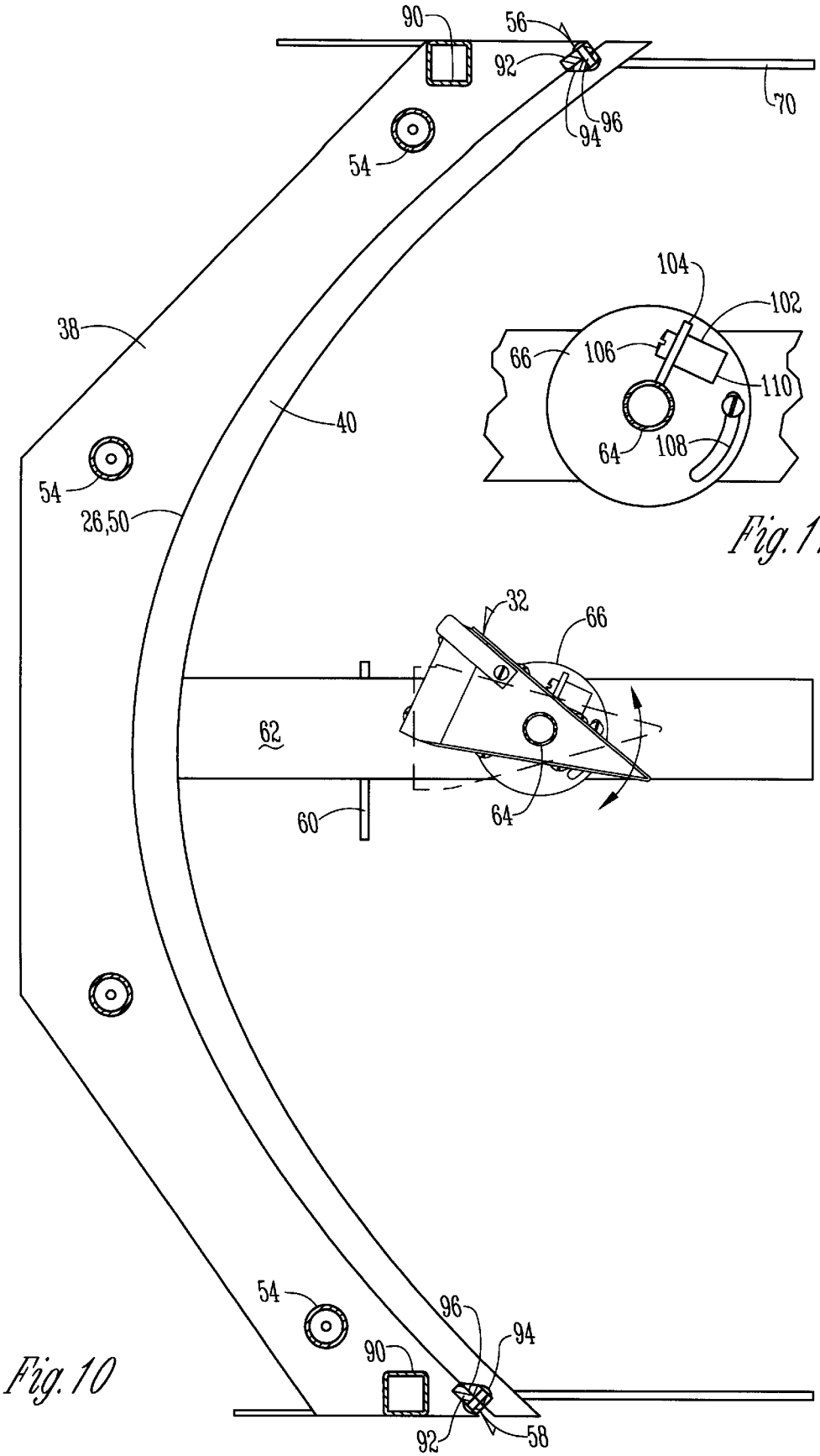
FIG. 10 is similar to FIG. 9, but shows the adjustability of a light source holder.
FIG. 11 is an enlarged, isolated view of the adjustment for the light source holder of FIG. 10.

FIG. 9 illustrates (in cross section) cross-bars 54 between base portions 38. It also illustrates in cross section tubular supports 90 at the top and bottom of base portions 38 and extending there between also for structural rigidity. Upper and lower cross-members are also shown in more detail in this sectional view. In each instance, a first member 92 is secured by welding or otherwise to base portion 38. A second member 94 (secured by welding or otherwise) to mating portion 40 is aligned with first member 92 when base and mating portions 38 and 40 are brought together. Appropriate apertures through both first and second members 92 and 94 receive a bold 96 which brings first and second members 92 and 94 together for further clamping action. As shown in FIG. 4, first and second members 92 and 94 run lengthwise across and between base and mating portions 38 and 40 and essentially clamp the top and bottom edges of reflector 26. FIGS. 9–11 also illustrate another feature related to light mount 32. As can be seen in FIG. 4, cross-bar 64 passes through apertures in opposite bars 62. Cross-bar 64 is pivotable within those apertures in bar 62. Plates 66 are welded or otherwise attached to cross-bar 64 at the location shown in FIG. 4. A block 102 is welded or otherwise secured to the interfacing side of adjustment plate 66. A tab 104 is welded or otherwise attached to the outside of cross-bar 64. A bolt 106 passed through tab 104 into a threaded aperture (not shown) in block 102. This arrangement thereby insures that any rotation of cross-bar 64 will also cause rotation of adjustment plate 66. Control of rotation of cross-bar 64 is accomplished by forming a slot 108 in adjustment plate 66. A set-screw 110 extends through slot 108 into a threaded aperture in bar 62. Thus, the limit of rotation of bar 64 is controlled by the opposite ends of slot 108.

Therefore, as can be seen by comparing FIGS. 9 and 10, in FIG. 9 light mount 32 is basically centered along bar 62 and set-screw 110 is basically centered in slot 108. In FIG. 10 light mount 32 is tilted upwardly, set-screw 110 goes to the top of slot 108. If light mounted 32 is desired to be tilted downwardly, set-screw 110 would go to the other end of slot 108. This arrangement allows adjustment of the position of the light source 28 relative to reflector 26. Thus, in FIG. 9, light source 28 would be basically directly along the center axis or the horizontal plane through the center of reflector 26, whereas in FIG. 10 light source 28 would be moved slightly above that plane. This would change the configuration of the beam created by this arrangement.

Thus, the basic construction of the preferred embodiment has been set forth. Additionally, the method of making the supporting structure for reflector 26 has been described.

Operation of the preferred embodiment is as follows. Once the shape of reflector 26 is selected and curve 50 is cut from original pieces 78 for both sides of reflector 26, frame 36 is assembled as previously described. Reflector 26 is held in position by the clamping action described above. Light source 28 is mounted in the desired position. Fine tuning of the position of light source 28 relative to reflector 26 can be accomplished. This can be done with such things as adjustment plate 66. Other adjustments are possible.

Side mirrors such as shown in FIG. 3 could be added if desired. Additionally, as it described in U.S. Ser. No. 08/375,650, the entire frame 36 could be tilted inside housing 10, if needed. Housing 10 itself can be adjusted in orientation as previously described.

Light source 28 is then operated to produce light energy as described in U.S. Ser. No. 08/375,650. A small primary reflector could be placed by light source 28 opposite reflector 26 to assist in controlling and directing light from that side of light source 28 back into reflector 26. It is to be understood, however, that such a primary reflector such as disclosed in U.S. Ser. No. 08/375,650 is not required for operation of this invention.

The precise shape of curves 50 and the assumption of that precise shape by reflector 26, therefore, allows very precise control of light from light source 28.

The included preferred embodiment is given by way of example only and not by way of limitation to the invention which is solely described by the claims herein. Variations obvious to one skilled in the art will be included within the invention defined by the claims.

For example, original pieces 78 which ultimately form base and mating portions 38 and 40, in the preferred embodiment are made of stress-relieved material such as stress-relieved steel. Aluminum is another possibility.

Cross-bars 54 and upper and lower cross-members 56 and 58 are preferably made of aluminum. This is because it is preferred that those parts have the same thermal coefficient of expansion as reflector 26 which in the preferred embodiment is specular aluminum.

As alluded to earlier, it is preferred that at least part of the reflector 26 be allowed to "float". In other words, the clamps would not be completely tightened down. This would allow for some thermal expansion or contraction so that there is not thermal distortion of reflector 26. This could be done by using flock nuts or spacers along bolts 46 to prevent them from completely tightening down, or by simply tightening, for example, the bottoms of mating portions 40 to base portions 38, but backing off on the top slightly.

While the preferred embodiment is discussed with respect to a single-piece, reflective sheet, it is to be understood that the invention can likewise function with segments. The segments could be sequentially stacked within curved 50 and base and mating portions 38 and 40 brought together to clamp them into position. Following are some dimensions of the preferred embodiment. It is to be understood that these can vary widely according to need and desire.

Width of frame 36 Approx. 24"

Height of base portions 38 Approx. 31"

Thickness of original pieces 78 ¼"

It is to be understood that if thermal distortion of the reflector is a problem or there is concern about the same, an option would be to use thicker material for the sheet reflector. Another option is to add one or more supports behind the reflector. Those supports could simply be base portions identical or substantially identical to base portions 38 at the sides of reflector 26. The curve of the additional base member(s) would be identical and would abut the back of reflector 26. No mating portion, like mating portion 40, would be used.

It is also to be understood that the curve that is created for reflector 26 can be of a variety of types and can be selected according to need. There is no requirement that the curve be of a certain type or formula. One way the curve is derived is essentially empirically. If cut off of light at a certain level is desired at a known distance from the fixture, a CAD system can be used to lay out the cut-off point or line or plane, and the fixture to scale. The known principles of physics, that light travels in straight lines and angle of incidence equals angle of reflection, can be used to figure out the precise shape of the curve. For example, if cut off for light from the entire fixture at a certain vertical height is desired at 100 feet from the fixture, light rays could be drawn from the cut-off point back to fixture. A predetermined shape, such as a parabola, as well as the size of the reflector can be pre-selected. A general shape of the reflector and size and position of the arc tube can be selected based, for example, on the concentration of the beam desired, the structural limits of the fixture, the size of the light source and other factors known in the art. The light rays would be drawn from the cut-off point to multiple points on the reflector, e.g. every ¼ inch. It is just a matter of then figuring out where the ray would be reflected so that its reflection would be tangent to the bottom-most part of the arc tube relative to it. For a description of the reason why a tangent line to the bottom of the arc tube can be seen at U.S. Ser. No. 08/375,650 filed Jan. 20, 1995, which is incorporated by reference herein. This is controlled by the angle of incidence equals the angle of reflectance. When coordinated in this manner, the surface of the reflector is defined for each ¼ inch because there is only one curve at that local area that could create a light ray tangent to the bottom of the arc tube that goes to the reflection surface and out to the cut-off point. There would then be created a plurality of small reflective surfaces along the CAD-created reflector. The CAD system can then smooth out the curve for the whole reflector and can be used to control a laser or other cutting machine to replicate that exact curve when cutting out the supports for the reflector.

Many times the reflector will be generally parabolic, generally elliptical, or a locus of points, that locally on the reflector, is nearly elliptical or parabolic.

What is claimed:

1. A lighting fixture comprising:

a set of frame members each having a contour defining a concave curve, the set positioned at parallel, spaced apart positions;

a reflector having an outer reflective surface and an inner surface, the reflector being placed across the contour of each frame member with the reflective surface facing outwardly and assuming the concave curve of the contour;

a securing member connected to the frame members and having a portion which abuts the reflective surface and applies retaining force against the reflector to secure the reflector to the frame members, the securing member including an adjustment to provide varying clamping force against the reflector;

a light source holder connected to at least one frame member and positioned in front of the reflective surface of the reflector.

2. The fixture of claim 1 further comprising cross-supports between frame members for supporting the frame members in the parallel spaced apart positions.

3. The fixture of claim 1 wherein the contour comprises a mathematical curve.

4. The fixture of claim 3 wherein the curve is selected form the set comprising a generally parabolic, generally elliptical, and a locus of points that locally on the reflector is nearly elliptical or parabolic.

5. The fixture of claim 1 wherein the reflector comprises a relatively flexible sheet having a highly specular reflective surface.

6. The fixture of claim 1 wherein the reflector comprises a plurality of segments of sheet-like material.

7. The fixture of claim 1 wherein the reflector comprises specular aluminum.

8. The fixture of claim 1 wherein the concave curve is a precise curve.

9. The fixture of claim 8 wherein the concave curve is formed by a precision cut.

10. The fixture of claim 9 wherein the precision cut is accomplished by a laser.

11. A reflector for providing a precise curvature for a reflecting surface comprising:

a frame;

the frame including first and second, spaced apart, parallel, and identical receiving surfaces, each receiving surface defining a precise curve;

first and second clamp members, each having a mating surface that precisely mates with the precise curve of the receiving surfaces;

a reflector removably positionable between the receiving and mating surfaces of the frame and clamp member;

securing members connectable between the frame and clamp members, the securing members being adjustable to move the clamp members closer or farther from the receiving surfaces.

12. The reflector of claim 11 wherein the precise curve is concave.

13. The reflector of claim 12 wherein the concave curve is a parabola.

14. The reflector of claim 11 wherein the frame comprises first and second plates, each having a receiving surface, and cross-members between said first and second plates holding them in a spaced apart parallel position.

15. The reflector of claim 11 further comprising a housing surrounding the frame.

16. The reflector of claim 11 wherein the frame comprises first and second brackets and a cross-member to hold first and second brackets spaced apart.

17. The reflector of claim 11 further comprising a light source positional in front of the reflector.

18. The reflector of claim 11 wherein the clamp members comprise brackets positioned on opposite sides of the reflector.

19. The reflector of claim 11 further comprising cross-members running across top and bottom edges of the reflector between clamping members.

20. The reflector of claim 11 wherein the precise curve is formed by precision computer controlled cut.

21. The reflector of claim 20 wherein the cut is made by a laser.

22. The process of making the reflector of claim 11 comprising:

cutting the precise curve in a plate by a laser so that first and second pieces are formed;

using the first piece as the frame;

using the second piece as the clamp member; so that the reflector edges are positionable in the precise laser cut curve and the reflector conforms to the precise curve by application of the mating clamp members created by the same cut through the plate.

23. The reflector of claim 11 wherein the curve defines a lighting direction.

24. The reflector of claim 23 wherein the lighting direction is substantially horizontal.

25. The reflector of claim 11 wherein the lighting direction is substantially vertical.

26. The reflector of claim 11 further comprising side mirrors on opposite sides of the reflector.

27. The reflector of claim 17 wherein the light source is mounted on an adjustable member connected to the frame so that the light source is adjustably positionable relative to the reflecting surface.

28. The reflector of claim 27 wherein the adjustable member includes means to move the light source towards and away the reflective surface.

29. The reflector of claim 27 wherein the adjustable member includes means to move the light source up and down relative to the reflective surface.

30. The reflector of claim 27 wherein the adjustable member includes means to move the light source angularly relative to the reflecting surface.

* * * * *

UNITED STATES PATENT AND TRADEMARK OFFICE

CERTIFICATE OF CORRECTION

PATENT NO. : 5,887,969
DATED : March 30, 1999
INVENTOR(S) : Myron K. Gordin

It is certified that error appears in the above-indentified patent and that said Letters Patent is hereby corrected as shown below:

In claim 28, column 10, line 26; please insert –from– following "away".

Signed and Sealed this

Twenty-eighth Day of September, 1999

*Attest:*

Q. TODD DICKINSON

*Attesting Officer*

*Acting Commissioner of Patents and Trademarks*